US010413914B2

(12) United States Patent
Arnold et al.

(10) Patent No.: US 10,413,914 B2
(45) Date of Patent: Sep. 17, 2019

(54) ENRICHMENT OF METAL SULFIDE ORES BY OXIDANT ASSISTED FROTH FLOTATION

(71) Applicant: Evonik Degussa GmbH, Essen (DE)

(72) Inventors: Gerhard Arnold, Ringwood, NJ (US); Terry Brown, New Orleans, LA (US); Ingo Hamann, Chester, NJ (US); Alan Hitchiner, Morrinsville (NZ)

(73) Assignee: Evonik Degussa GmbH, Essen (DE)

( * ) Notice: Subject to any disclaimer, the term of this patent is extended or adjusted under 35 U.S.C. 154(b) by 1104 days.

(21) Appl. No.: 14/374,526

(22) PCT Filed: Jan. 25, 2013

(86) PCT No.: PCT/EP2013/051438

§ 371 (c)(1),
(2) Date: Jul. 25, 2014

(87) PCT Pub. No.: WO2013/110757

PCT Pub. Date: Aug. 1, 2013

(65) Prior Publication Data

US 2014/0369906 A1 Dec. 18, 2014

Related U.S. Application Data

(60) Provisional application No. 61/591,839, filed on Jan. 27, 2012.

(51) Int. Cl.
*B03D 1/02* (2006.01)
*B03D 1/002* (2006.01)
(Continued)

(52) U.S. Cl.
CPC ..... *B03D 1/02* (2013.01); *B03D 1/002* (2013.01); *B03D 1/0043* (2013.01); *B03D 1/012* (2013.01);
(Continued)

(58) Field of Classification Search
CPC ..... B03D 1/02
See application file for complete search history.

(56) References Cited

U.S. PATENT DOCUMENTS 1,893,517 A 1/1933 Gaudin
2,310,240 A 10/1939 Keck
(Continued)

FOREIGN PATENT DOCUMENTS

AU 2010236082 5/2011
BR 9505931 12/1997
(Continued)

OTHER PUBLICATIONS

Greet, et al., Is Measuring pH Enough?, Metallurgical Plant Design and Operating Strategies (MetPlant 2006)(Sep. 2006).*
(Continued)

*Primary Examiner* — Melissa S Swain
(74) *Attorney, Agent, or Firm* — Law Office of: Michael A. Sanzo, LLC

(57) ABSTRACT

The present invention is directed to methods that can be used in the enrichment of metal sulfide ores in desired minerals in cases where the ores have sulfide-containing gangues. The method involves adding an oxidant to slurries prepared from the ores during, or immediately prior to froth flotation.

15 Claims, 5 Drawing Sheets

(51) Int. Cl.

| | |
|---|---|
| ***B03D 1/012*** | (2006.01) |
| ***B03D 1/014*** | (2006.01) |
| ***B03D 1/004*** | (2006.01) |

(52) U.S. Cl.
CPC ..... *B03D 1/014* (2013.01); *B03D 2201/007* (2013.01); *B03D 2201/02* (2013.01); *B03D 2201/04* (2013.01); *B03D 2203/02* (2013.01); *B03D 2203/025* (2013.01)

(56) References Cited

U.S. PATENT DOCUMENTS

| | | | | |
|---|---|---|---|---|
| 2,559,104 | A | | 7/1951 | Arbiter et al. |
| 3,137,649 | A | | 6/1964 | De Benedictis et al. |
| 3,426,896 | A | | 2/1969 | Baarson et al. |
| 3,539,002 | A | | 11/1970 | Last |
| 3,811,569 | A | | 5/1974 | Shirley et al. |
| 4,098,686 | A | | 7/1978 | Petrovich |
| 4,174,274 | A | | 11/1979 | Tolley et al. |
| 4,427,772 | A | * | 1/1984 | Kodera ..... G01N 27/4163 204/403.14 |
| 4,466,886 | A | | 8/1984 | Petrovich |
| 4,549,959 | A | | 10/1985 | Armstrong et al. |
| 4,588,498 | A | | 5/1986 | Mair et al. |
| 4,600,505 | A | | 7/1986 | Mair et al. |
| 4,618,461 | A | | 10/1986 | Bergman et al. |
| 4,702,824 | A | | 10/1987 | Abadi |
| 4,902,765 | A | | 2/1990 | Wang et al. |
| 5,013,359 | A | | 5/1991 | Fair et al. |
| 5,037,533 | A | | 8/1991 | Piedrahita et al. |
| 5,110,455 | A | | 5/1992 | Huch |
| 5,171,428 | A | | 12/1992 | Beattie et al. |
| 5,275,791 | A | * | 1/1994 | Knorre ..... C22B 11/08 423/29 |
| 5,295,585 | A | | 3/1994 | Huch |
| 5,389,274 | A | | 2/1995 | Fernandez |
| 5,411,148 | A | | 5/1995 | Kelebek et al. |
| 5,837,210 | A | | 11/1998 | Simmons et al. |
| 5,855,770 | A | * | 1/1999 | Clark ..... B03B 1/04 209/166 |
| 5,902,977 | A | | 5/1999 | Arbiter |
| 6,210,648 | B1 | | 4/2001 | Gathje et al. |
| 6,390,303 | B1 | | 5/2002 | Clark et al. |
| 6,427,843 | B1 | | 8/2002 | Clark |
| 7,004,326 | B1 | | 2/2006 | Dai et al. |
| 9,839,917 | B2 | | 12/2017 | Greet et al. |
| 2003/0231995 | A1 | | 12/2003 | Jarra et al. |
| 2004/0222164 | A1 | | 11/2004 | Conaway et al. |
| 2016/0144381 | A1 | | 5/2016 | Greet et al. |
| 2016/0158768 | A1 | | 6/2016 | Arnold et al. |
| 2016/0167060 | A1 | | 6/2016 | Arnold et al. |

FOREIGN PATENT DOCUMENTS

| | | | |
|---|---|---|---|
| EP | 0 261 847 | | 3/1988 |
| GB | 1 218 981 | | 1/1971 |
| GB | 340 598 | | 1/1981 |
| GB | 2 182 587 | | 5/1987 |
| JP | 56-141856 | | 11/1981 |
| RU | 2 067 030 | | 9/1996 |
| RU | 2 426 598 | C1 | 8/2011 |
| RU | 2 432 999 | C2 | 11/2011 |
| SU | 1740450 | | 6/1992 |
| WO | WO 87/00088 | | 1/1987 |
| WO | WO 93/22060 | | 11/1993 |
| WO | WO 96/40438 | | 12/1996 |
| WO | WO 03/045567 | | 6/2003 |
| WO | WO 2004/035218 | | 4/2004 |
| WO | WO 2011/067680 | | 6/2011 |
| WO | WO 2013/110420 | | 8/2013 |
| WO | WO 2015/007649 | A1 | 1/2015 |
| WO | WO 2015/007652 | A1 | 1/2015 |
| WO | WO 2015/007654 | A1 | 1/2015 |

OTHER PUBLICATIONS

Asian, et al., The Effect of Reagent Addition Points and Aeration on the Flotation Performance of Sulphide Minerals, 18th International Mining Congress and Exhibiti of Turkey—IMCET, p. 265-470 (Year: 2003).*

International Preliminary Report on Patentability for PCT/EP2014/064945 (international counterpart of U.S. Appl. No. 14/904,696), filed Jul. 11, 2014.

International Preliminary Report on Patentability for PCT/EP2014/064953 (international counterpart of U.S. Appl. No. 14/904,697), filed Jul. 11, 2014.

International Preliminary Report on Patentability for PCT/EP2014/064957 (international counterpart of U.S. Appl. No. 14/904,698), filed Jul. 11, 2014.

U.S. Appl. No. 14/904,696, filed Jan. 13, 2016, Greet.

U.S. Appl. No. 14/904,697, filed Jan. 13, 2016, Arnold.

U.S. Appl. No. 14/904,698, filed Jan. 13, 2016, Arnold.

Office Action for corresponding Kazakhstan patent application 2014/1682.1 with English language translation attached, dated Apr. 7, 2016.

First page of Kazakhstan patent KZ 3930 C with copy of U.S. Pat. No. 4,902,765 attached, Sep. 16, 1996.

International Search Report for PCT/EP2014/064945 filed Jul. 11, 2014.

Written Opinion of the International Searching Authority for PCT/EP2014/064945 filed Jul. 11, 2014.

International Search Report for PCT/EP2014/064953 filed Jul. 11, 2014.

Written Opinion of the International Searching Authority for PCT/EP2014/064953 filed Jul. 11, 2014.

International Search Report for PCT/EP2014/064957 filed Jul. 11, 2014.

Written Opinion of the International Searching Authority for PCT/EP2014/064957 filed Jul. 11, 2014.

Hintikka, et al., "Potential control in the flotation of sulphide minerals and precious metals," *Minerals Engineering* 8(10):1151-1158 (Oct. 1995).

International Search Report for PCT/EP2013/051438 filed Jan. 25, 2013.

Written Opinion of the International Searching Authority for PCT/EP2013/051438 filed Jan. 25, 2013.

International Preliminary Report on Patentability for PCT/EP2013/051438 filed Jan. 25, 2013.

International Search Report for PCT/EP2012/076297 filed Dec. 20, 2012.

Written Opinion of the International Searching Authority for PCT/EP2012/076297 filed Dec. 20, 2012.

International Preliminary Report on Patentability for PCT/EP2012/076297 filed Dec. 20, 2012.

Bruckard, et al., "The flotation of metallic arsenic as a function of pH and pulp potential—A single mineral study," *Int. J Miner. Process*. 84(1-4):25-32 (Sep. 2007).

Dai, et al., "Arsenic Rejection in the Flotation of Garson Ni—Cu Ore," Australian Institute of Mining and Metallurgy Publication Series: Centenary of Flotation Symposium; pp. 939-946 (Jun. 6, 2005).

Jones, "Some recent developments in the measurement and control of xanthate, perxanthate, sulphide, and redox potential in flotation," *Int. J. Miner. Process*. 33(1-4):193-205 (Jan. 1991).

Ma, et al., "Rejection of arsenic minerals in sulfide flotation—A literature review," *Int. J. Miner. Process*. 93(2):89-94 (Oct. 2009).

Ralston, "$E_h$ and Its Consequences in Sulphide Mineral Flotation," *Minerals Engineering* 4(7-11):859-878 (Jan. 1991).

Richardson, et al., "Electrochemical Control of Sulfide Flotation Circuits," Symposium on Emerging Computer Techniques for the Mineral Industry, pp. 307-317 (Feb. 1, 1993).

Uribe-Salas, et al., "Metallurgical improvement of a lead/copper flotation stage by pulp potential control," *Int. J. Miner. Process*. 59(1):69-83 (Apr. 2000).

English language abstract for BR9505931, (published Dec. 23, 1997).

(56) References Cited

OTHER PUBLICATIONS

English language abstract for RU2067030, (published Sep. 27, 1996).
Office Action for copending U.S. Appl. No. 14/904,698, dated Feb. 23, 2017.
Office Action for copending U.S. Appl. No. 14/904,696, dated Feb. 27, 2017.
Office Action for copending U.S. Appl. No. 14/904,697, dated Feb. 28, 2017.
Notice of Allowance for copending U.S. Appl. No. 14/904,696, dated Aug. 2, 2017.
Response to Office Action for copending U.S. Appl. No. 14/904,696, filed May 22, 2017.
Response to Office Action for copending U.S. Appl. No. 14/904,697, filed May 27, 2017.
Response to Office Action for copending U.S. Appl. No. 14/904,698, filed May 22, 2017.
Final Office Action for copending U.S. Appl. No. 14/904,697, dated Sep. 27, 2017.
Notification re abandonment for copending U.S. Appl. No. 14/904,697, filed Oct. 11, 2018.
Final Office Action for copending U.S. Appl. No. 14/904,698, dated Oct. 2, 2017.
Notification re abandonment for copending U.S. Appl. No. 14/904,698, dated Oct. 11, 2018.

* cited by examiner

ENRICHMENT OF METAL SULFIDE ORES BY OXIDANT ASSISTED FROTH FLOTATION

CROSS REFERENCE TO RELATED APPLICATIONS

The present application is US national stage of international application PCT/EP2013/051438, which had an international filing date of Jan. 25, 2013. The application claims the benefit of US provisional application No. 61/591,839, filed on Jan. 27, 2012.

FIELD OF THE INVENTION

The present invention is directed to a method of improving the grade and recovery of desired base minerals, especially copper, from metal sulfide ores that have a sulfide-containing gangue.

BACKGROUND OF THE INVENTION

The most common means of recovering a desired mineral from a metal sulfide ore is by a procedure that includes froth flotation (*Froth Flotation: A Century of Innovation*, Fuerstenau, et al. eds., Soc. Mining, Metallurgy and Exploration, 2007). Typically, ores are suspended in water and ground using milling equipment to the "liberation size," i.e., the largest particle size which exposes the desired mineral to the action of flotation reagents (usually about 50-200 μm). The ground ore forms a pulp which is fed to flotation cells that are typically arranged in banks of roughers, scavengers and cleaners.

During froth flotation, air is introduced into the pulp as fine bubbles which provide a surface for the attachment of relatively hydrophobic minerals. These minerals then rise with the bubbles to the surface of flotation cells and are removed. The hydrophilic gangue particles are less attracted to the air bubbles and therefore tend to be left behind in the pulp. Frothers (such as pine oil, polyglycols and polyoxyparafins) and pH modifiers (such as CaO, $Na_2CO_3$, NaOH or $H_2SO_4$, HCl) may be used to improve separations. Collectors (e.g., xanthates, carbonates and fatty acids) may also be introduced to help promote the attachment of minerals to air bubbles. In more complicated flotation circuits, the minerals may be either collected with the froth product (known as the overflow) or with the tail, or underflow. In addition, scavenger, cleaner, and re-cleaner cells, with or without an intermediate re-grinding step, may also be employed.

The proper oxygenation of pulp is an important parameter in the flotation of complex metal sulfide ores (*Surface Chemistry of Froth Flotation*, Jan Leja, Plenum Press (1982)). For example, it has been reported that conditioning of ore slurries with oxidants such as hydrogen peroxide can be used as part of a process to separate a desired copper mineral from unwanted iron sulfide, as well as from other copper-containing minerals (U.S. Pat. Nos. 5,110,455 and 5,295,585). However, incorrect oxygen levels may adversely affect separations and recovery. Thus, the conditions under which oxygenation is performed is important to the ultimate success of these enrichment procedures.

SUMMARY OF THE INVENTION

The present invention is directed to the addition of oxidants, preferably hydrogen peroxide, during froth flotation of a metal sulfide ore to improve the separation of a desired mineral from an unwanted sulfide-containing gangue. The grinding, pH adjustment, and addition of other chemicals (frothers and collectors) may be performed prior to the addition of the oxidant and the entry of pulp into the flotation cells. However, it is important to avoid conditioning ore pulp with $H_2O_2$ (or any other oxidant) prior to flotation as this may adversely affect recovery.

The proper amount of oxidant to be used may be determined for a given ore by using varying amounts of oxidant and measuring the dissolved oxygen content (DO) in the flotation feed. By plotting the resulting DO against the concentration of the oxidant, it is possible to determine the optimum amount of said oxidant that should be added. Specifically, increasing amounts of oxidant should lead to a point where a sharp increase in DO occurs, i.e., where there is a substantial increase in the slope of the DO vs. In [oxidant] curve (see e.g., FIG. 10 for hydrogen peroxide as oxidant). Between about 0.5 and 10 times of the oxidant addition at this point is the amount of oxidant that can most favorably be used in the processes described herein. Once process parameters have been determined, these may be used in the future processing of the same ore.

In its first aspect, the invention is directed to a process for treating a metal sulfide ore to separate a desired mineral from a sulfide-containing gangue. The desired mineral may be any that is of value, however copper ores and copper/gold ores are preferred. A typical sulfide-containing gangue to be removed would be iron sulfide, in particular pyrite ($FeS_2$). The process involves forming a pulp by suspending the ore in water and then milling it to form small particles, typically 50-200 μm in diameter. Using procedures well known in the art, the pulp is then enriched in the desired mineral by froth flotation. This is a procedure in which oxygen or air is bubbled through the pulp and a concentrate enriched in the desired mineral is collected. In order to improve separations, an oxidant is added to the pulp immediately prior to (i.e., within 30 seconds) or, preferably, directly during froth flotation. Preferably, the desired mineral is enriched in froth formed by the froth flotation. Avoiding the conditioning of pulp is important in optimizing the results. In addition, the procedure may be performed without adjusting the pH of the pulp with agents such as lime.

The most preferred oxidant is hydrogen peroxide. Other oxidants that may be used include sodium nitrate, sodium hypochlorite, potassium dichromate and sodium peroxodisulfate. The oxidant should, most preferably, be added continuously during the froth flotation procedure and, to avoid reduced recoveries due to localized decomposition of the oxidant, should be added in a diluted form. For example, hydrogen peroxide is preferably added at a concentration of 0.5-20% by weight, more preferably at 0.5-5% by weight, and still more preferably at 0.5-1% by weight. The continuous addition of low concentrations of oxidant during froth flotation may be used not only for the process described herein but in other procedures for enriching ores as well.

The amount of oxidant that should be added to the pulp will vary depending on the type of ore being processed. As suggested above, one way to determine the optimum amount is to perform assays measuring changes in the dissolved oxygen content of the slurry after various amounts of oxidant have been added. The objective of these assays is to determine the amount of oxidant at an inflection point, i.e., a point where the curve of the amount of dissolved oxygen plotted against the logarithm of the concentration of added oxidant evidences a sudden increase in slope (see e.g., FIG. 10). The amount of oxidant added should be between half of this amount and 10 times this amount. In the case of hydrogen peroxide, typically, 0.01-0.5 kg (and more specifically 0.03-0.3 kg) of hydrogen peroxide will be used per ton of ore milled (weights of hydrogen peroxide refer to 100% hydrogen peroxide).

Although the hydrogen peroxide may be added as one or more batches, it is most preferably added continuously during the froth flotation process. Typically, the rate of addition should be between 0.03 kg per ton of ore and 0.5 kg/t and, more specifically, between 0.03 kg/t and 0.3 kg/t. The rate of addition per ton of ore processed will be largely dependent on the composition of the ore and the rate at which the mill processes the ore.

Frothers and collectors may be added to slurries prior to froth flotation in order to improve separations and recoveries. Examples of frothers that may be used include pine oil, polyglycols, and polyoxyparafins. Examples of collectors that may be used include xanthates, carbonates, and fatty acids.

In another aspect, the invention is directed to an improvement in processes for enriching metal sulfide ores in a desired mineral (particularly ores with sulfide-containing gangue). The processes are characterized by the steps of: a) suspending the ore in water and milling it (typically by grinding to a particle size of 50-200 μm) to form a pulp; b) performing froth flotation by bubbling oxygen or air through a pulp, to which hydrogen peroxide has been added and collecting a concentrate composition enriched in the desired mineral from the pulp surface. The improvement comprises adding an aqueous hydrogen peroxide solution comprising 0.5-20% by weight hydrogen peroxide to the pulp during froth flotation, or immediately before (within 30 seconds of) froth flotation. The hydrogen peroxide solution preferably comprises 0.5-5% by weight, and more preferably at 0.5-1% by weight hydrogen peroxide. The hydrogen peroxide solution is preferably added continuously during froth flotation.

The parameters used in the improved procedure are essentially the same as those discussed above. Oxidant should be added without any conditioning of the slurry and it is not necessary to adjust pH by adding lime or some other similar pH adjusting agents. Although oxidant can be added in one or more individual batches, it should preferably be added continuously in the concentration ranges discussed above. Typically, the rate of addition should be between 0.01 kg per ton of ore and 0.5 kg/t and, more specifically, between 0.03 kg/t and 0.3 kg/t. The rate of addition per ton of ore processed is dependent on the composition of the ore and on the rate at which the mill processes the ore. Preferred minerals for enrichment are copper sulfides and gold and a typical sulfide-containing gangue that will be separated by the process is iron sulfide, in particular pyrite ($FeS_2$). Besides the beneficial effect on an increased grade or recovery in the desired base metal, the procedure may also have the effect of removing unwanted, or potentially harmful, impurities such as arsenic. Optionally, frothers and/or collectors, such as those listed above, may be added to slurries to improve separations.

In another aspect, the invention is directed to a method of increasing the hydrophilicity of a sulfide-containing gangue during froth flotation of a metal sulfide ore slurry, using the methods described above. This modification may then be used to help facilitate separation of a gangue from a desired mineral.

BRIEF DESCRIPTION OF THE DRAWINGS

FIG. 1 shows curves in which the copper grade (y-axis) is plotted against the recovery of copper (x-axis) for flotation experiments described in examples 1, 2 and 4. The figure presents curves obtained under standard conditions in the absence and in the presence of 100 g/t and 200 g/t $H_2O_2$. The preparations were not conditioned with hydrogen peroxide.

FIG. 2 shows curves in which the copper grade (y-axis) is plotted against the recovery of copper (x-axis) for flotation experiments described in examples 1, 3 and 5. The figure presents curves obtained under standard conditions in the absence and in the presence of 100 g/t and 200 g/t $H_2O_2$. Preparations that contained the hydrogen peroxide were conditioned with this agent for 15 minutes prior to the flotation process.

FIG. 3 is a graph in which the recovery of iron sulfide (IS, y-axis) is plotted against the recovery of copper (x-axis) for an ore processed in examples 1, 2 and 4 under standard conditions in the absence and in the presence of 100 g/t and 200 g/t $H_2O_2$. Processing was performed without conditioning.

FIG. 4 is a graph in which the recovery of non-sulfide gangue (NSG, y-axis) is plotted against the recovery of copper (x-axis) for an ore processed in examples 1, 2 and 4 under standard conditions in the absence and in the presence of 100 g/t and 200 g/t $H_2O_2$. Processing was performed without conditioning.

FIG. 5 is a graph in which the recovery of arsenic (y-axis) is plotted against the recovery of copper (x-axis) for an ore processed in examples 1, 2 and 4 under standard conditions in the absence and in the presence of 100 g/t and 200 g/t $H_2O_2$. Processing was performed without conditioning.

FIG. 6 is a graph in which the concentration of dissolved oxygen (DO, y-axis) is plotted against the logarithm of the amount of added $H_2O_2$ (in g/t of mineral, x-axis) for the experiments of adding $H_2O_2$ to aqueous slurries of pure pyrite and pure chalcopyrite described in experiments 7-10 and 12-15.

FIG. 7 is a graph in which the copper grade (y-axis) is plotted against the recovery of copper (x-axis) for flotation experiments described in examples 16-20. The figure presents curves obtained under standard conditions in the absence and in the presence of 50-200 g/t $H_2O_2$. The preparations were not conditioned with hydrogen peroxide.

FIG. 8 shows curves in which the copper grade (y-axis) is plotted against the recovery of copper (x-axis) for flotation experiments described in examples 24-29 using various oxidants applied at the same molar $O^{2-}$ dosage rate.

FIG. 9 shows curves in which the copper grade (y-axis) is plotted against the recovery of copper (x-axis) for flotation experiments described in examples 30-36. The figure presents curves obtained under standard conditions in the absence and in the presence of 7.5 to 240 g/t H2O2. The preparations were not conditioned with hydrogen peroxide.

FIG. 10 is a graph in which the concentration of dissolved oxygen (DO, y-axis) is plotted against the natural logarithm of the amount of $H_2O_2$ (in kg/t ore, x-axis) added in examples 30-36.

DEFINITIONS

Figure 1:
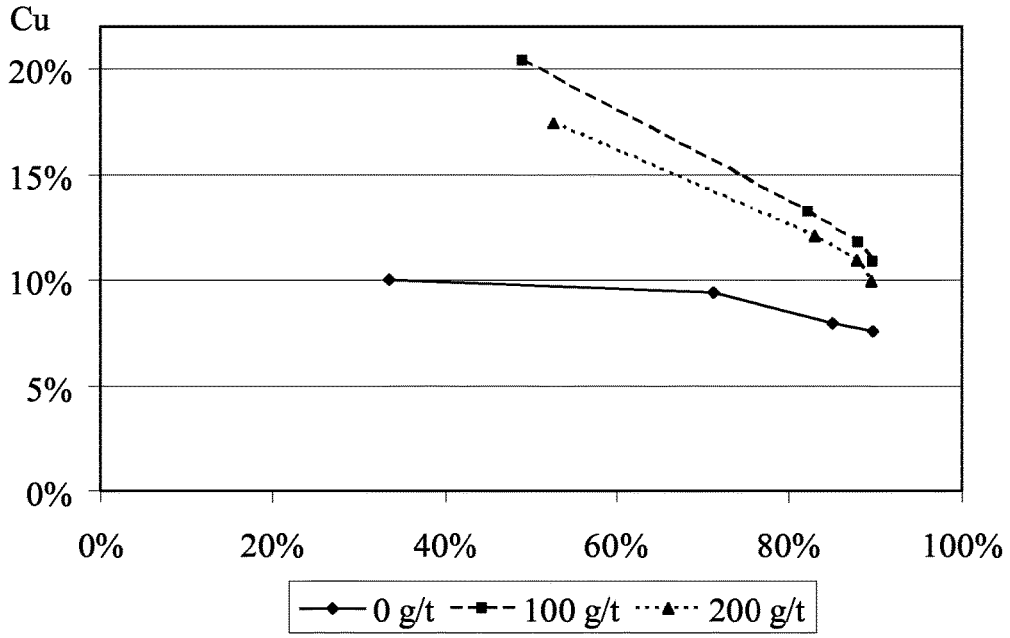
FIG. 1.
Figure 2:
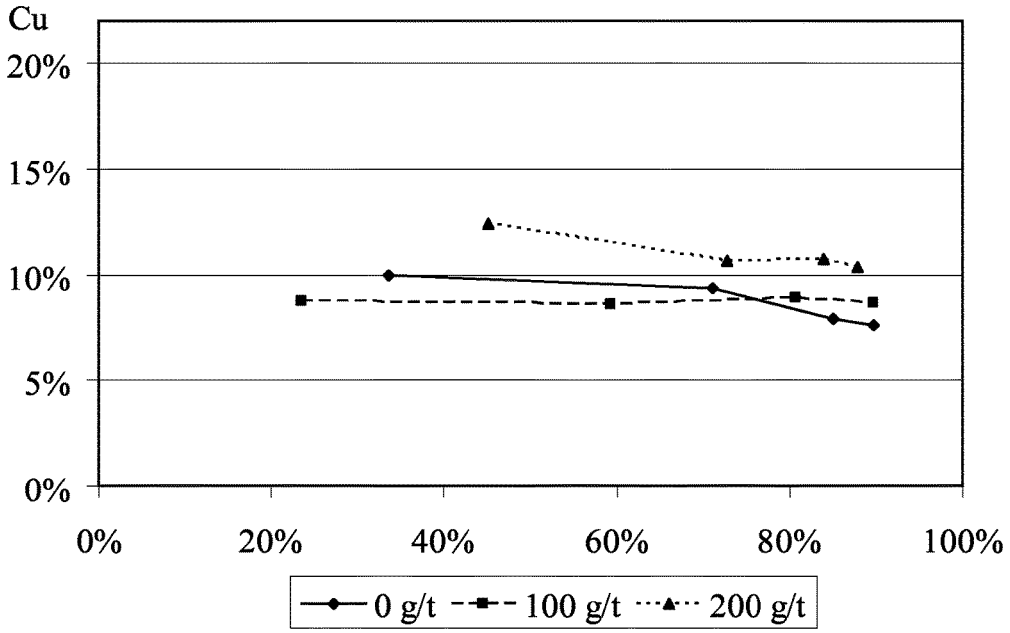
FIG. 2.

The following definitions are provided to facilitate an understanding of the invention. They apply to the terms used herein unless there is an indication to the contrary either expressly or by context.

Ore

A naturally occurring mineral from which a metal and certain other elements (e.g. phosphorus) can be extracted, usually on a commercial basis. Metals may be present in ores in elemental form, but more commonly they occur combined as oxides, sulfides, sulfates or silicates.

Copper/Gold Ore

An ore containing sufficient copper and gold to make economically feasible the extraction of the metals from the ore.

Mineral

A mineral is a naturally occurring solid material found in ore and having a characteristic structure and specific physical properties. A mineral may be a metal or a non-metal, such as a metal sulfide.

Froth Flotation

Froth flotation is a method for separating various minerals in a feed by utilising differences in their surface properties. Separation is achieved by passing air bubbles through the mineral pulp. By adjusting the chemistry of the pulp using various reagents, valuable minerals can be made aerophilic (air-avid) and gangue minerals aerophobic (water avid). Separation occurs by the valuable minerals adhering to the air-bubbles which form the froth floating on the surface of the pulp.

Frother

A frother is a compound or composition added to a mineral pulp which increases the amount and stability of froth formed upon passing air bubbles through the mineral pulp.

Collector

A collector is a compound or composition added to a mineral pulp which increases the amount of a desired mineral that attaches to air bubbles passing through the mineral pulp.

Depressant

A depressant is a compound or composition added to a mineral pulp which reduces the amount of gangue that attaches to air bubbles passing through the mineral pulp.

Ore Concentration

Ore concentration is the process of separating milled ore into two streams; a concentrate enriched in a desired mineral and Tailings of waste material. Ore concentration is a vital economic step in production processes because it reduces the volume of material which must be transported to, and processed in, a smelter and refinery.

Conditioning of Ore Slurry

Conditioning of ore slurry refers to treating ore slurry with reagents, such as depressants, frothers, activators, collectors, pH regulators, etc. for a given time period before entering the flotation cells in order to improve separation.

Gangue

Gangue is a material in an ore other than a desired mineral. Gangues usually have little or, essentially, no economic value.

Grade

Grade is the mass of a desired material in a given mass of ore.

Milling

Typically, in an initial stage of mineral processing, ore from a mine is mechanically reduced in size to improve the efficiency of a concentration process. In general, two types of mills are used. Autogenous mills simply tumble the ore to achieve a desired grain size, whereas other mills use an additional medium, such as steel balls or rods, to aid milling.

Pulp

Ground ore and water are mixed to form a pulp. For the purposes of the present invention, the terms "slurry," "ore slurry," "pulp" and "ore pulp" are all used interchangeably.

Recovery

The amount of desired mineral obtained as the result of a froth flotation process relative to the amount originally present is the recovery. In order to minimize the volume of material that needs to be handled, the grade of recovered material should be as high as possible.

By-product

A by-product is a material of some economic value produced in a process which is focused on extracting another material. For example gold may be produced as a by-product of copper mining.

Tailings

Tailings are fine grain remains of ore once most of the valuable material has been removed in a concentration process.

DETAILED DESCRIPTION OF THE INVENTION

The present invention is directed to an improvement in froth flotation procedures by selective alteration of the surface chemistry of sulfide-containing gangues in metal sulfide ores using oxidants such as hydrogen peroxide. The metal sulfide ore is preferably a copper ore, containing copper sulfide minerals, or a copper/gold ore, containing copper sulfide minerals and associated gold. The sulfide-containing gangue in such ores is typically an iron sulfide such as pyrite. Without being held to any particular theory, it is believed that the oxidant alters the surface of gangue sulfide compounds to make them more hydrophilic. This is illustrated below for the oxidation of pyrite ($FeS_2$) by hydrogen peroxide.

$$FeS_2+7.5H_2O_2 \rightarrow FeO(OH)H_2O+2H_2SO_4+4H_2O$$

As oxidant is added to the pulp, the first iron sulfide to have its surface chemistry altered will typically be pyrite, the most common of the sulfide minerals. Should the oxidant concentration be further increased, oxidation reactions will continue with other iron sulfide species such as arsenopyrite and pyrrhotite. Continued addition of the oxidant will ultimately change the surface chemistry of these metal sulfides to make them more hydrophilic and less prone to be present in the concentrate recovered in the froth. Adding too much oxidant can lead to surface modification of a desired metal sulfide mineral, such as chalcopyrite, which will increase loss of this mineral to the tailings. The addition of oxidant may also change the surface chemistry of arsenic and bismuth compounds, such as e.g. arsenopyrite, present in the ore to make them more hydrophilic and less prone to be present in the concentrate recovered in the froth.

An especially important characteristic of the present invention is that there is no, or essentially no, conditioning of ore preparations with oxidant prior to froth flotation as this may adversely affect recovery. Conditioning by the incubation of the ore slurry in the presence of other agents, e.g., frothers or collectors, may still occur, but oxidants such as hydrogen peroxide should not be present. Although a pH modifier such as lime can be used to condition the slurry, it is not necessary to include such agents and the cost of ore processing can be reduced if they are omitted.

Preferably, the oxidant is added directly to flotation cells while oxygen or air is bubbled through the slurry and there is no prior conditioning of the slurry with the oxidant. However, less desirably, addition may take place immediately prior to (within 30 seconds of) froth flotation. The oxidant is preferably added continuously during froth flotation. Grinding, pH adjustment (if used), and addition of other chemicals (frothers and collectors) may be performed prior to the addition of oxidant. All of these other steps, including the production of slurries of ore appropriate for mineral enrichment, are carried out using methods that are well known in the mining arts. Preferably, no frother, collector, additional depressant or pH modifier is added after addition of oxidant. Most preferably, the oxidant is added after addition of other flotation aids, such as frother, collector, additional depressant or pH modifier.

The preferred oxidant is hydrogen peroxide. Other oxidants that may be used include sodium nitrate, sodium hypochlorite, potassium dichromate and sodium peroxodisulfate. The oxidant is preferably not molecular oxygen. The oxidant should, most preferably, be added continuously during the froth flotation procedure and, to avoid reduced recoveries due to localized decomposition of the oxidant, should be added in a diluted form. For example, hydrogen peroxide is preferably added at a concentration of 0.5-20% by weight, more preferably at 0.5-5% by weight, and still more preferably at 0.5-1% by weight.

The amount of oxidant to add to ore slurries is an important factor in determining the degree of enrichment achieved. For example, 0.01-0.5 kg of hydrogen peroxide per ton of ore would be expected to produce generally positive results. However, the optimal amount of oxidant to add will vary depending on the components making up the ore. In order to estimate the amount of oxidant to add for a given ore, the ore should be processed by froth flotation in the presence of increasing amounts of oxidant while measuring the dissolved oxygen content of the slurry. Plotting the results should provide a curve such as that shown in FIG. 10 for the addition of hydrogen peroxide. It can be seen from the figure that, as the amount of added hydrogen peroxide increases, an inflection point is reached where there is a sudden increase in the slope of the curve. For convenience, the inflection point is defined herein as being the point in the curve where there is at least a doubling in slope. Expressing the amount of oxidant in the slurry at this point as "x," the preferred amount of oxidant to use is between 0.5× and 10×. This can be arrived at by either adding the required amount of oxidant to the slurry in one or more batches or by adding the oxidant in a continuous manner during froth flotation. It should be noted that once a preferred range is arrived at, this can then be applied to the processing of similarly prepared slurry from the same ore. If the composition of the ore changes, the procedure can be repeated to determine a new optimum amount of oxidant.

If desired, the tailings from the initial processing step can be further treated by froth flotation in an attempt to recover additional mineral. Since the tailings will be of a lower grade than the initial ore, the preferred range of hydrogen peroxide to add should be separately determined using the procedure described above.

EXAMPLES

Examples 1 to 5

A porphyry copper/gold ore was ground in the presence of water to a particle size P80 of 200 μM using a laboratory Magotteaux® mill. A head assay of the ore gave the following result: 0.84% Cu, 20.9% Fe, 562 ppm As, 0.40 ppm Au, 147 ppm Mo and 4.1% S.

The resulting ore pulp was transferred to a flotation cell and mixed for two minutes to homogenize. Xanthate collector (2:1 potassium amyl xanthate and sodium isobutyl xanthate) was added at 5 grams per ton as well as a 1% by weight aqueous hydrogen peroxide solution at 100 or 200 g hydrogen peroxide (100%) per ton. The pulp was then conditioned for 0 or 15 minutes. Five drops of OTX140 frother from Cytec (sodium diisobutyl dithiophosphate) was added and pH was maintained at nominally 10.8 via addition of lime. Four timed concentrates were collected over intervals of 30 seconds, 1.5, 2.0 and 4.0 minutes, for a total flotation time of 8 minutes. Each concentrate was collected by hand scraping the froth from the surface of the pulp once every 10 seconds. pH, redox potential Eh, dissolved oxygen content and temperature of the pulp were monitored throughout the tests.

Results for Examples 1-5 are shown in Tables 1 and 2 below and in FIGS. 1-5. Data points in FIGS. 1-5 refer to the combined timed concentrates obtained by flotation. As can be seen, a significant improvement in copper grade can be attributed to improved copper selectivity against iron sulfides (pyrite). Overall, the addition of hydrogen peroxide improved concentrate copper grade. Specifically, at 85% copper recovery, the improvement in concentrate copper grade was as much as 3.7% higher than without hydrogen peroxide (Table 1 and FIG. 1). Also, copper grade/recovery curves show that copper flotation rates increase with unconditioned hydrogen peroxide addition, while conditioning the pulp prior to flotation had a negative effect on the copper flotation response.

Hydrogen peroxide, in addition to improving concentrate grade, was also beneficial with respect to copper recovery. Specifically, at 8% concentrate copper grade, copper recovery was significantly higher for all the hydrogen peroxide tests compared to the standard (Table 2).

Although the addition of hydrogen peroxide improved copper selectivity against iron sulfides, there was a concern that gold recovery might be reduced as a significant proportion of the gold in this ore (and in many other ores) is associated with iron sulfides. However, hydrogen peroxide addition without conditioning improved gold recovery with respect to the standard test, and Tables 1 and 2 illustrate similar gold grade compared to standard.

Figure 3:
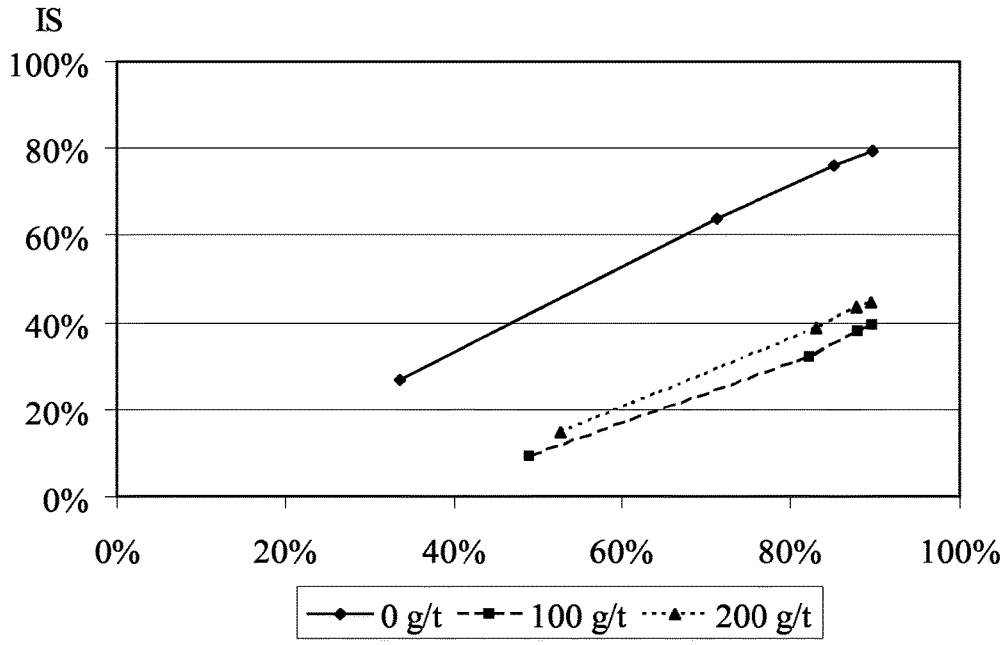
FIG. 3.

Iron sulfide recoveries were lower for all hydrogen peroxide tests, with respect to the standard test. However, conditioning in conjunction with 100 g and 200 g $H_2O_2$ addition per ton of pulp was associated with an increased tendency to recover sulfides (copper vs. iron sulfide selectivity is shown in FIG. 3).

Figure 4:
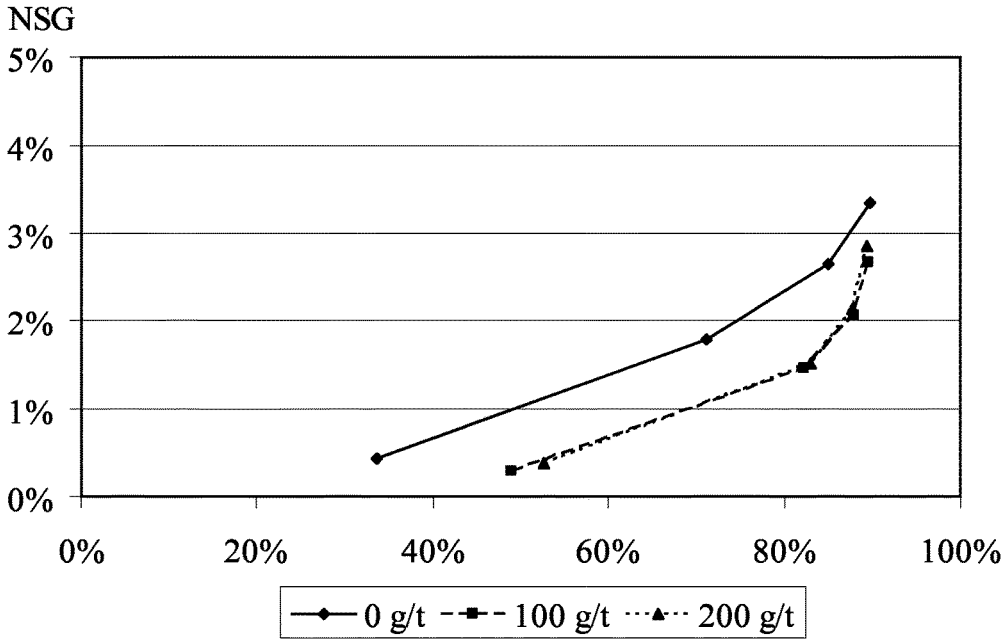
FIG. 4.

Besides improved selectivity toward iron sulfide, hydrogen peroxide treatment during flotation also results in lower non-sulfide gangue (NSG) at any given copper recovery (see FIG. 4).

Figure 5:
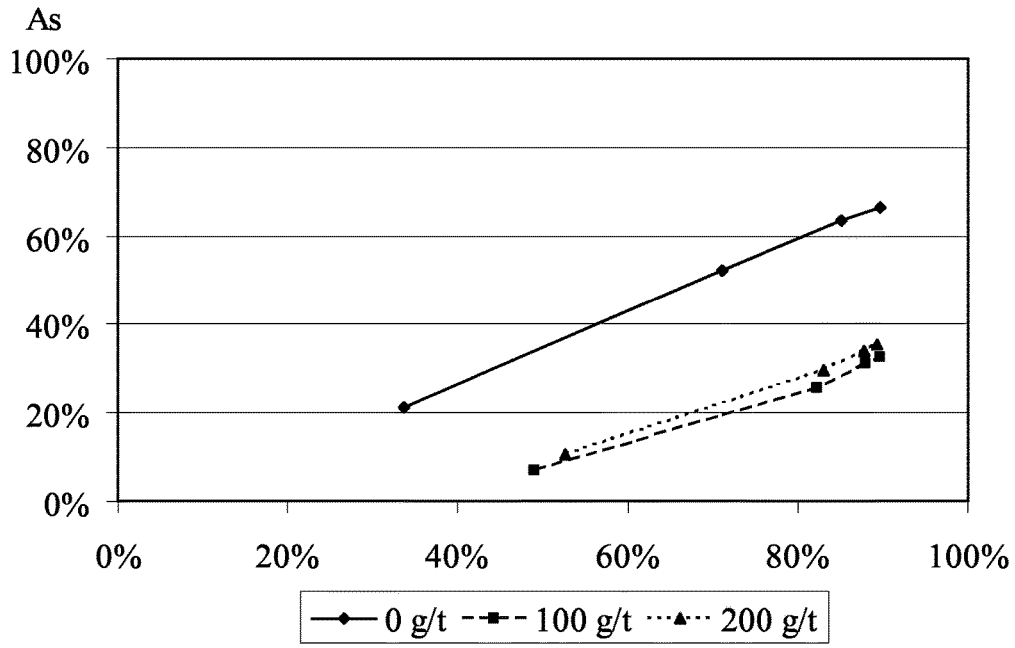
FIG. 5.

Arsenopyrite (FeAsS) is the most common arsenic mineral in ores and is also a by-product associated with copper, gold, silver, and lead/zinc mining. Arsenic occurs at varying levels in some copper ore bodies and is a significant environmental hazard in the copper smeltering process when emissions are released into the atmosphere. The arsenic in the ore is contained in copper-arsenic sulfide minerals, such as enargite and tennanite. High arsenic levels may reduce the value of the concentrate and therefore its removal is highly desirable. Table 1 and FIG. 5 show a substantial arsenic reduction at 85% copper recovery.

TABLE 1

Copper and gold concentrate grades and gold and diluent recoveries, at 85% copper recovery

| Example | $H_2O_2$ added, Conditioning time | Grade Cu % | Grade Au ppm | Recovery Au % | Recovery Mo % | Recovery As % | Recovery IS % | Recovery NSG % |
|---|---|---|---|---|---|---|---|---|
| 1* Standard | 0 g/ton, 15 min | 7.9 | 3.2 | 69.4 | 43.8 | 63.4 | 76.0 | 2.6 |
| 2 | 100 g/ton, 0 min | 11.6 | 4.4 | 72.7 | 34.2 | 31.4 | 40.7 | 1.8 |
| 3* | 100 g/ton, 15 min | 10.7 | 3.9 | 68.4 | 40.2 | 29.0 | 43.4 | 2.2 |
| 4 | 200 g/ton, 0 min | 8.8 | 3.9 | 77.3 | 41.0 | 42.3 | 58.6 | 2.9 |
| 5* | 200 g/ton, 15 min | 9.8 | 3.7 | 68.1 | 36.2 | 33.4 | 45.4 | 2.7 |

Note:

*not according to the invention, IS = iron sulfide, NSG = non-sulfide gangue

TABLE 2

Copper and gold recoveries and concentrate gold and diluent grades, at 8% concentrate copper grade

| Example | $H_2O_2$ added, Conditioning time | Recovery Cu % | Recovery Au % | Grade Au ppm | Grade Mo ppm | Grade As ppm | Grade IS % | Grade NSG % |
|---|---|---|---|---|---|---|---|---|
| 1* Standard | 0 g/ton, 15 min | 82.8 | 67.5 | 3.2 | 670 | 3812 | 49.8 | 26.3 |
| 2 | 100 g/ton, 0 min | 91.7 | 84.2 | 3.2 | 664 | 2261 | 29.5 | 46.9 |
| 3* | 100 g/ton, 15 min | 91.0 | 78.7 | 3.0 | 756 | 1983 | 28.8 | 47.7 |
| 4 | 200 g/ton, 0 min | 90.7 | 83.7 | 3.5 | 685 | 2635 | 37.2 | 39.1 |
| 5* | 200 g/ton, 15 min | 90.6 | 76.9 | 3.1 | 661 | 2116 | 29.9 | 46.5 |

Note:

*not according to the invention, IS = iron sulfide, NSG = non-sulfide gangue

Examples 6 to 15

An oxidation treatment with hydrogen peroxide was applied to "pure" minerals pyrite and chalcopyrite. pH was maintained at a target value of 11 via addition of lime. The aim of this approach was to isolate the behavior of each mineral tested to various concentrations of oxidation treatment. Examples 6-15 in Tables 3 and 4 illustrate that pyrite consumes much more oxidant than chalcopyrite before hydrogen peroxide addition leads to an increase in dissolved oxygen.

Figure 6:
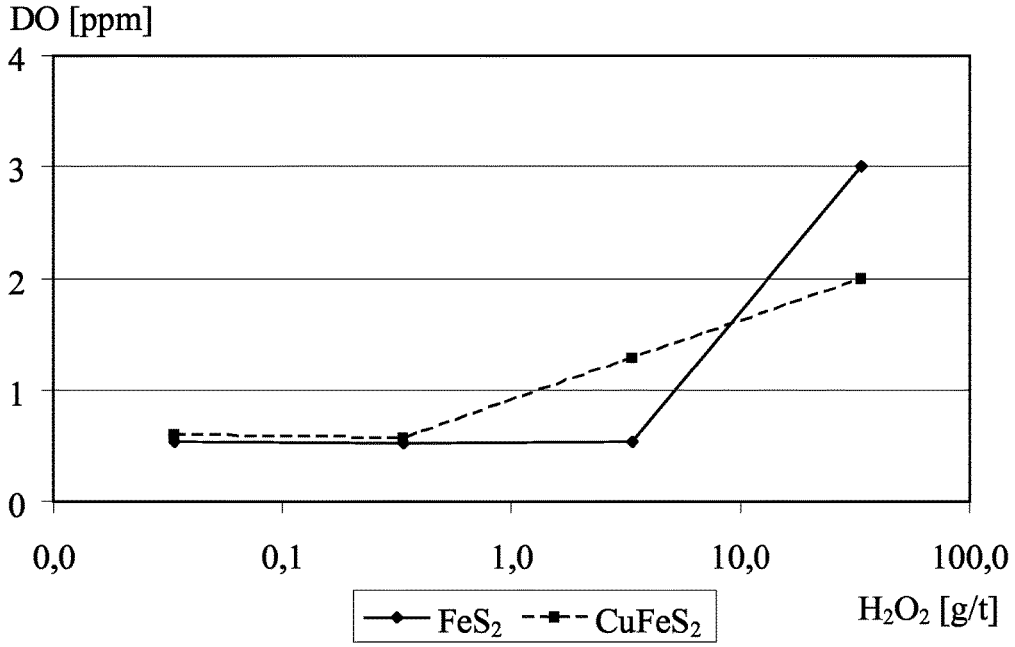
FIG. 6.

FIG. 6 shows that pure pyrite ore "requires" more hydrogen peroxide to get oxidized compared to chalcopyrite. Chalcopyrite only requires about 0.34 g/ton of $H_2O_2$ for DO to drastically increase (thereby making it more hydrophilic), whereas the pyrite mineral required a much higher amount (3.4 g/ton of $H_2O_2$) in the slurry to produce a similar effect. This difference in DO suggests that it should be possible to separate these species, by floating chalcopyrite and removing pyrite in tailings.

TABLE 3

Pure Pyrite Mineral treated with Hydrogen Peroxide

| Example | $H_2O_2$ added g/t | DO ppm | pH | Eh mV | Temperature ° C. |
|---|---|---|---|---|---|
| 6 | 0 | 0.46 | 10.9 | 148 | 20.8 |
| 7 | 0.034 | 0.53 | 11.0 | 86 | 19.1 |
| 8 | 0.34 | 0.52 | 11.0 | 153 | 18.3 |
| 9 | 3.4 | 0.53 | 10.8 | 119 | 21.3 |
| 10 | 34 | 3.01 | 10.8 | 211 | 22.8 |

Note:

DO = dissolved oxygen,

Eh = redox potential

TABLE 4

Pure Chalcopyrite Mineral treated with Hydrogen Peroxide

| Example | $H_2O_2$ added g/t | DO ppm | pH | Eh mV | Temperature ° C. |
|---|---|---|---|---|---|
| 11 | 0 | 0.49 | 10.9 | 132 | 24.1 |
| 12 | 0.034 | 0.59 | 11.0 | 125 | 18.8 |
| 13 | 0.34 | 0.57 | 11.1 | 124 | 22.2 |
| 14 | 3.4 | 1.28 | 10.9 | 181 | 21 |
| 15 | 34 | 1.99 | 10.8 | 214 | 25.2 |

Note:

DO = dissolved oxygen,

Eh = redox potential

Examples 16 to 20

Figure 7:
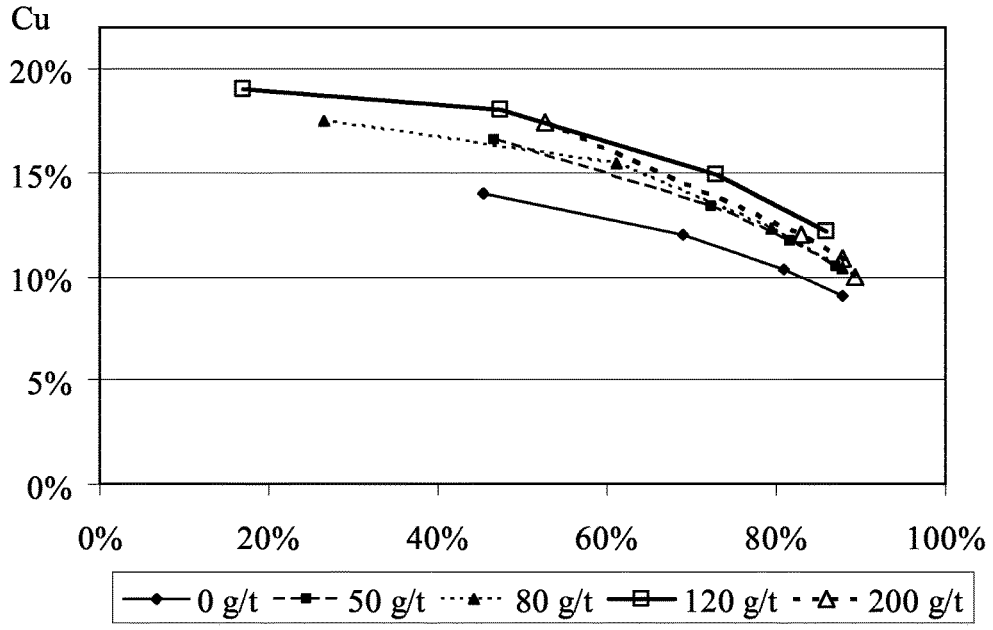
FIG. 7.

Examples 16-20 were carried out as described for examples 1-5 using a different ore and adding varying amounts of hydrogen peroxide without conditioning time. They are designed to examine hydrogen peroxide in amounts sufficient to over oxidize the ore. In other words, the highest amounts of peroxide used should also oxidize chalcopyrite and thereby make it hydrophilic with the other sulfides. At 50, 80, 120, and 200 g/ton of peroxide, copper grade reached its maximum with 120 g/ton $H_2O_2$ and 200 g/t provided inferior results indicating, that over-oxidation took place (see Tables 5 and 6, FIG. 7).

TABLE 5

Copper and gold concentrate grades and gold and diluent recoveries, at 86% copper recovery

| Example | $H_2O_2$ added g/t | Grade Cu % | Grade Au ppm | Recovery Au % | Recovery Mo % | Recovery As % | Recovery IS % | Recovery NSG % |
|---|---|---|---|---|---|---|---|---|
| 16* | 0 | 9.3 | 3.4 | 67.8 | 32.7 | 41.0 | 53.8 | 2.6 |
| 17 | 50 | 11.0 | 4.0 | 69.3 | 29.0 | 30.7 | 42.9 | 1.9 |
| 18 | 80 | 10.8 | 3.6 | 63.7 | 26.5 | 24.9 | 34.8 | 2.7 |
| 19 | 120 | 11.0 | 4.0 | 66.5 | 32.8 | 26.3 | 35.0 | 2.5 |
| 20 | 200 | 8.8 | 3.9 | 77.3 | 41.0 | 42.3 | 58.6 | 2.9 |

Note:

*not according to the invention, IS = iron sulfide, NSG = non-sulfide gangue

TABLE 6

Copper and gold recoveries and concentrate gold and diluent grades, at 8 percent concentrate copper grade

| Example | $H_2O_2$ added g/t | Recovery Cu % | Recovery Au % | Grade Au ppm | Grade Mo ppm | Grade As ppm | Grade IS % | Grade NSG % |
|---|---|---|---|---|---|---|---|---|
| 16* | 0 | 89.6 | 74.4 | 3.0 | 629 | 2783 | 37.7 | 38.6 |
| 17 | 50 | 90.3 | 78.5 | 2.9 | 546 | 2118 | 30.8 | 45.6 |
| 18 | 80 | 90.7 | 74.8 | 2.8 | 507 | 1733 | 25.3 | 51.2 |
| 19 | 120 | 90.7 | 77.0 | 3.0 | 609 | 1864 | 25.5 | 51.0 |
| 20 | 200 | 90.7 | 83.7 | 3.5 | 685 | 2635 | 37.2 | 39.1 |

Note:

*not according to the invention, IS = iron sulfide, NSG = non-sulfide gangue

Examples 21 to 23

Examples 21-23 were carried out as described for examples 1-5, using a different copper/gold ore following grinding using forged steel media. Sodium ethyl xanthate was used as collector and added after grinding at 15 grams per ton of ore. The pulp was transferred to the flotation cell and conditioned for two minutes. The slurry was then further conditioned with 35 grams of sodium ethyl xanthate and 30 grams per ton of POLYFROTH® H27 frother from Huntsman. The desired concentration of hydrogen peroxide (0, 50 and 100 grams per ton) was added to the flotation feed and flotation commenced immediately. During this set of tests, no lime to adjust pH was added. Flotation took place at the natural pH of 8.1. Results are shown in Tables 7 and 8 below.

The addition of hydrogen peroxide increased dissolved oxygen in the flotation feed as well as the response of the ore to flotation in general. Cumulative copper and gold recovery increased by 2.6 and 7.0%, respectively. Also copper grade increased by 1.5%.

At 73% copper recovery and 50 g/t $H_2O_2$, copper grade increased by 3.5% and arsenic and iron sulfides recovery decreased by 3 and 0.7%, respectively. At 18% copper grade and 50 g/t $H_2O_2$, copper recovery increased by 4.5% and gold recovery increased by 9.4%.

TABLE 7

Copper and gold grade, gold, molybdenum and diluents recovery at 73% copper recovery

| Example | $H_2O_2$ added g/t | Grade Cu % | Grade Au ppm | Recovery Au % | Recovery Mo % | Recovery As % | Recovery S % | Recovery IS % | Recovery NSG % |
|---|---|---|---|---|---|---|---|---|---|
| 21* Standard | 0 | 17.4 | 5.3 | 59.1 | 11.3 | 12.7 | 69.5 | 68.2 | 4.4 |
| 22 | 50 | 20.9 | 6.5 | 62.7 | 9.7 | 9.7 | 68.9 | 67.5 | 2.2 |
| 23 | 100 | 22.1 | 6.6 | 55.8 | 8.9 | 11.1 | 69.0 | 67.5 | 2.1 |

Note:

*not according to the invention, IS = iron sulfide, NSG = non-sulfide gangue

TABLE 8

Copper and gold recovery, gold, molybdenum and diluents grade at 18% copper grade

| Example | $H_2O_2$ added g/t | Recovery Cu % | Recovery Au % | Grade Au ppm | Grade Mo ppm | Grade As ppm | Grade S % | Grade IS % | Grade NSG % |
|---|---|---|---|---|---|---|---|---|---|
| 21* Standard | 0 | 72.2 | 58.1 | 5.5 | 78 | 125 | 15.0 | 19.6 | 57.8 |
| 22 | 50 | 76.7 | 67.5 | 5.7 | 84 | 110 | 15.1 | 19.7 | 57.8 |
| 23 | 100 | 77.8 | 61.5 | 5.5 | 89 | 131 | 14.8 | 19.1 | 58.3 |

Note:

*not according to the invention, IS = iron sulfide, NSG = non-sulfide gangue

Examples 24 to 29

Figure 8:
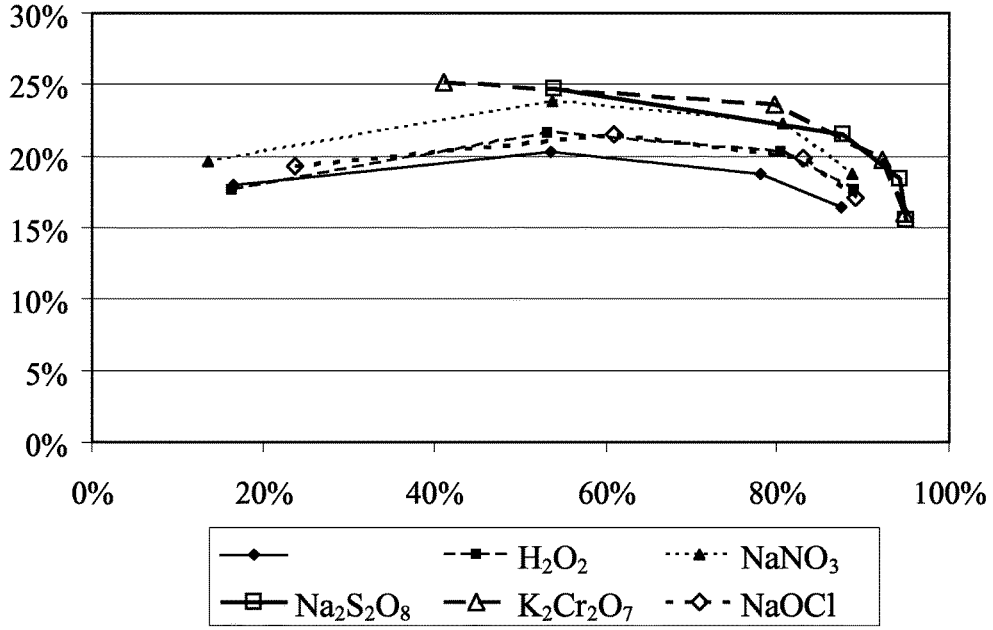
FIG. 8.

Examples 24-29 were carried out as described for examples 1-5, using different oxidants and a different copper/gold ore following grinding using forged steel media. The ground pulp was transferred from the laboratory mill to a 5 liter flotation cell and mixed for two minutes to homogenize the pulp. The slurry was then aerated for 12 minutes at 10 l/min to match the plant oxygen demand prior to flotation. The pulp was then conditioned for 2 minutes with 16.5 g/t of a blend of sodium isopropyl ethyl thionocarbamate and dithiophosphate and 5 drops of IF52 frother (isobutyl methyl carbinol), both from Chemical & Mining Services Pty. Four timed concentrates were collected over intervals of 30 seconds, 1.5, 3.0 and 5.0 minutes, for a total flotation time of 10 minutes. Each concentrate was collected by hand scraping the froth from the surface of the pulp once every 10 seconds. Oxidants $H_2O_2$, $NaNO_3$, $Na_2S_2O_8$, $K_2Cr_2O_7$ and NaOCl were used at the same molar O2-dosage rate, assuming the following O2-equivalents for the oxidants: $H_2O_2$=0.5, $NaNO_3$=0.5, $Na_2S_2O_8$=0.5, $K_2Cr_2O_7$=1 and NaOCl=0.25. Oxidants were added to the flotation feed and flotation commenced immediately. Flotation was performed at natural pH of 8.0, without addition of lime. Results are shown in Table 9 and FIG. 8.

Overall, the addition of oxidants improved concentrate copper grade. At 85% copper recovery, the improvement in concentrate copper grade was as much as 5.0% higher than without oxidant.

Table 9 also illustrates improved gold grade of up to 5.1 ppm. While copper and gold concentrate grades at 85% copper recovery improved, iron sulfide recoveries were substantially lower for all oxidants tested. Besides improved selectivity toward iron sulfide, oxidant addition during flotation also results in lower non-sulfide gangue (see Table 9).

TABLE 9

Copper and gold concentrate grades and gold and diluent recoveries, at 85% copper recovery

| Example | Oxidant | Grade Cu % | Grade Au ppm | Recovery Au % | Recovery S % | Recovery IS % | Recovery NSG % |
|---|---|---|---|---|---|---|---|
| 24* | None | 16.9 | 23.7 | 57.0 | 50.2 | 14.4 | 3.5 |
| 25 | $H_2O_2$ | 19.1 | 26.6 | 48.4 | 49.4 | 6.6 | 3.0 |
| 26 | $NaNO_3$ | 20.4 | 28.4 | 29.7 | 46.6 | 10.4 | 2.0 |
| 27 | $Na_2S_2O_8$ | 21.9 | 28.9 | 53.0 | 49.1 | 13.7 | 1.5 |

TABLE 9-continued

| Copper and gold concentrate grades and gold and diluent recoveries, at 85% copper recovery | | | | | | | |
|---|---|---|---|---|---|---|---|
| | | Grade | | Recovery | | | |
| Example | Oxidant | Cu % | Au ppm | Au % | S % | IS % | NSG % |
| 28 | $K_2Cr_2O_7$ | 21.9 | 26.8 | 51.2 | 49.7 | 13.6 | 1.6 |
| 29 | NaOCl | 18.8 | 28.4 | 58.4 | 51.2 | 19.1 | 2.2 |

Note:
*not according to the invention, IS = iron sulfide, NSG = non-sulfide gangue

Examples 30-36

Figure 9:
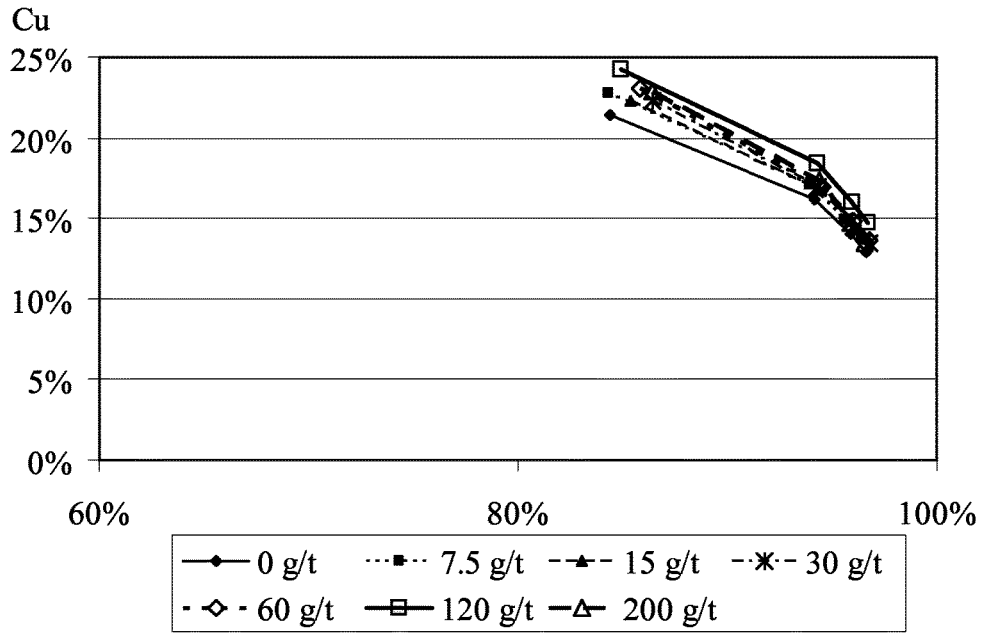
FIG. 9.

Examples 30-36 were carried out as described for examples 1-5, using a different ore following grinding using forged steel media. Prior to the reagent addition the float feed was aerated for 7 minutes to simulate plant conditions. Sodium ethyl xanthate was used as collector and added after grinding at 21 grams per tone of ore. The pulp was transferred to the flotation cell and conditioned for two minutes. The slurry was mixed with 5 grams per ton of POLY-FROTH® H27 frother from Huntsman. During this set of tests, lime was added to adjust the pH to a value of 9.7. The desired amount of hydrogen peroxide (0, 7.5, 15, 30, 60, 120 and 240 grams per ton) was added to the flotation feed and flotation commenced immediately. Results are shown in Tables 10 and 11 and FIG. 9.

At 120 g/t of hydrogen peroxide the copper grade increased by 1.8 percentage points at a constant recovery of 96% vs. the example with no addition, while at 15% copper grade the recovery rose by 0.9 percentage points. Copper grade reached its maximum with an addition of 120 g/t $H_2O_2$ and further increasing the amount of $H_2O_2$ to 240 g/t provided inferior results.

TABLE 10

| Copper concentrate grades and diluents recovery at 96% Copper recovery | | | | | | | |
|---|---|---|---|---|---|---|---|
| | $H_2O_2$ | Grade | Recovery | | | | |
| Example | added g/t | Cu % | Zn % | Fe % | S % | IS % | NSG % |
| 30* | 0 | 12.9 | 78.4 | 26.7 | 34.1 | 15.5 | 9.5 |
| 31 | 7.5 | 13.7 | 67.4 | 27.2 | 32.5 | 18.5 | 8.3 |
| 32 | 15 | 13.8 | 67.8 | 26.9 | 33.5 | 15.5 | 8.9 |
| 33 | 30 | 13.5 | 64.4 | 26.6 | 33.2 | 16.4 | 9.0 |
| 34 | 60 | 13.7 | 72.0 | 27.8 | 33.6 | 14.9 | 9.2 |
| 35 | 120 | 14.7 | 71.8 | 27.2 | 33.2 | 15.7 | 6.5 |
| 36 | 240 | 13.5 | 67.4 | 27.0 | 32.5 | 14.0 | 8.6 |

Note:
*not according to the invention, IS = iron sulfide, NSG = non-sulfide gangue

TABLE 11

| Copper recoveries and diluents grade at 15% Copper grade | | | | | |
|---|---|---|---|---|---|
| | $H_2O_2$ added | Recovery | Grade | | |
| Example | g/t | Cu % | Zn % | IS % | NSG % |
| 30* | 0 | 95.9 | 0.37 | 19.5 | 31.8 |
| 31 | 7.5 | 95.6 | 0.32 | 24.4 | 30.3 |
| 32 | 15 | 96.0 | 0.33 | 21.3 | 31.7 |
| 33 | 30 | 96.0 | 0.32 | 22.9 | 32.3 |
| 34 | 60 | 96.1 | 0.34 | 18.9 | 33.3 |

TABLE 11-continued

| Copper recoveries and diluents grade at 15% Copper grade | | | | | |
|---|---|---|---|---|---|
| | $H_2O_2$ added | Recovery | Grade | | |
| Example | g/t | Cu % | Zn % | IS % | NSG % |
| 35 | 120 | 96.8 | 0.33 | 20.4 | 33.7 |
| 36 | 240 | 95.9 | 0.34 | 19.7 | 31.2 |

Figure 10:
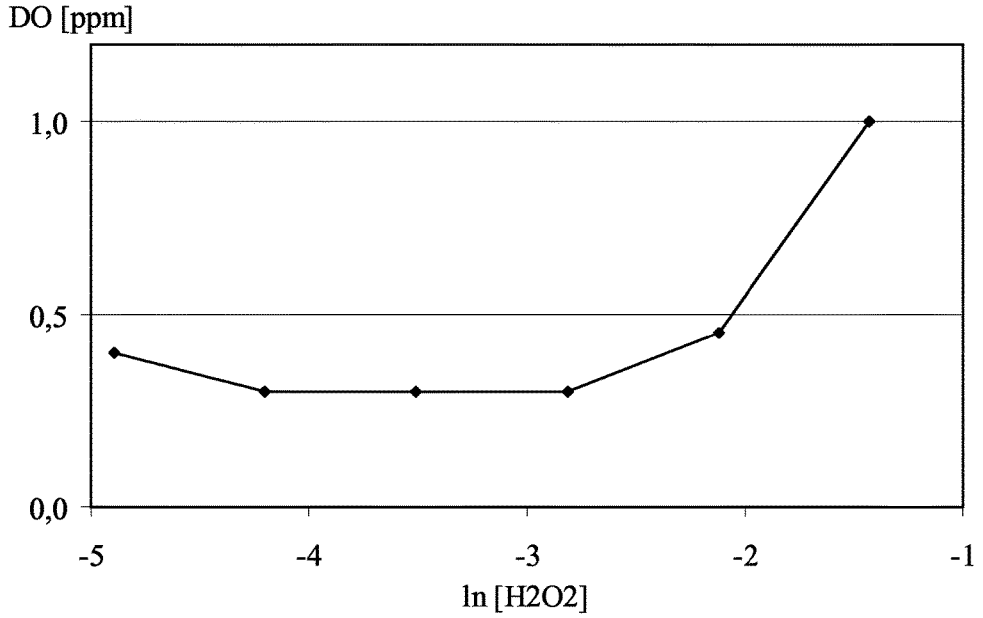
FIG. 10.

Note:
*not according to the invention,
IS = iron sulfide,
NSG = non-sulfide gangue FIG. 10 shows a plot of dissolved oxygen (DO) concentration against the natural logarithm of the amount of added hydrogen peroxide in kg/t of ore. The slope is relatively flat up to 0.12 kg/t and then becomes much steeper as the amount of added $H_2O_2$ increases.

All references cited herein are fully incorporated by reference. Having now fully described the invention, it will be understood by those of skill in the art that the invention may be practiced within a wide and equivalent range of conditions, parameters and the like, without affecting the spirit or scope of the invention or any embodiment thereof.

What is claimed is:

1. A process for treating a metal sulfide ore to separate a desired mineral from a sulfide-containing gangue, comprising:

a) forming a pulp by suspending the ore in water and milling said ore; and b) enriching the pulp in said desired mineral by froth flotation, wherein hydrogen peroxide is added to said pulp immediately prior to, or during, bubbling of oxygen or air into said pulp;

wherein an amount of hydrogen peroxide to be added in said process is determined by performing assays using varying amounts of hydrogen peroxide added to the pulp, measuring the dissolved oxygen content after hydrogen peroxide addition and plotting the resulting dissolved oxygen content against the concentration of the hydrogen peroxide.

2. The process of claim 1, wherein said process comprises at least one of the following characteristics:

a) said hydrogen peroxide is added continuously during froth flotation without prior conditioning of the pulp with said hydrogen peroxide;

b) no frother, collector, additional depressant or pH modifier is added after addition of oxidant.

3. The process of claim 1, wherein an aqueous hydrogen peroxide solution comprising 0.5-20% by weight hydrogen peroxide is added to said pulp.

4. The process of claim 1, wherein an aqueous hydrogen peroxide solution comprising 0.5-5% by weight hydrogen peroxide is added to said pulp.

5. The process of claim 1, wherein an aqueous hydrogen peroxide solution comprising 0.5-1% by weight hydrogen peroxide is added to said pulp.

6. The process of claim 1, wherein said process comprises at least one of the following characteristics:

a) said hydrogen peroxide is added without adjustment of pH;

b) said desired mineral is enriched in froth formed by the froth flotation;

c) said desired mineral is a copper sulfide.

7. The process of claim 1, wherein said desired mineral is a copper sulfide and said sulfide-containing gangue is iron sulfide.

8. The process of claim 1, wherein said desired mineral is a copper sulfide and undesirable minerals are reduced in said concentrate pulp as a result of the froth flotation procedure.

9. The process of claim 1, wherein the amount of hydrogen peroxide added is 0.01-0.5 kg/t of ore.

10. The process of claim 9, wherein the amount of hydrogen peroxide added is 0.03-0.3 kg/t of ore.

11. The process of claim 9, wherein said desired mineral is a copper sulfide.

12. The process of claim 11, wherein said sulfide-containing gangue is iron sulfide.

13. The process of claim 1, wherein an optimum amount of hydrogen peroxide to be added in said process is determined by plotting the dissolved oxygen content against the natural logarithm of the amount of hydrogen peroxide added.

14. The process of claim 13, wherein the optimum amount of hydrogen peroxide is 0.5 to 10 times the amount of hydrogen peroxide added at the inflection point of the plot.

15. The process of claim 1, wherein said hydrogen peroxide is added without adjustment of pH.

* * * * *